United States Patent [19]

Price et al.

[11] 3,931,768

[45] Jan. 13, 1976

[54] HOPPER VEHICLE

[75] Inventors: Albert E. Price, Brookfield; Erling Mowatt-Larssen, Warren, both of Ohio

[73] Assignee: General American Transporation Corporation, Chicago, Ill.

[22] Filed: Dec. 4, 1974

[21] Appl. No.: 529,499

[52] U.S. Cl. ..... 105/240; 105/251; 105/288; 105/308 E

[51] Int. Cl.[2] ..... B61D 3/00

[58] Field of Search ..... 105/240, 251, 255, 258, 105/308 E, 308 P, 308 B, 310, 248, 250, 105/284, 288, 304

[56] References Cited

UNITED STATES PATENTS

| | | | |
|---|---|---|---|
| 3,408,956 | 11/1968 | Rebenok et al. | 105/240 |
| 3,596,608 | 8/1971 | Aquino et al. | 105/240 X |
| 3,772,996 | 11/1973 | Schuller | 105/240 |
| 3,868,913 | 3/1975 | Becker et al. | 105/240 |

*Primary Examiner*—John J. Love
*Attorney, Agent, or Firm*—Claron N. White

[57] ABSTRACT

A novel hopper vehicle, illustratively a freight hopper car, has a floor with two longitudinal hoppers and a pair of side-opening doors on opposite sides of the center line of the vehicle. Each door provides a part of one of the hoppers and is pivotally mounted on a side sill of the vehicle. Preferably each door is a wrap-around door to provide also a lower part of a side of the body of the vehicle and its pivotal mounting is on an intermediate side sill that extends between the sloping end walls of the body of the vehicle at an intermediate elevation. The body of the vehicle has fixed side walls. For the central portion of the floor of the car body there is a longitudinally-extending, inverted V-shaped panel that is mounted above the intermediate portion of the center sill of the car and that provides by its sloping walls the other part of the hoppers. In the construction with wrap-around doors the fixed side walls form only a part of the sides of the body. Each of the two opposed doors is connected to a novel door-operating, power-operated mechanism that functions also, as soon as the door is closed, to provide a positive locking, preferably a three-point locking, of the door. Each of the door-operating mechanisms is preferably a compound latching mechanism including a lever pivotally mounted at its bottom end on the bottom margin of the door and having its distal end portion pivotally connected to power means mounted on the supporting structure of the vehicle for movement of the lever between a first position abutting the inside of the door when it is unlocked and a second position spaced from the inside of the door when it is closed and the compound mechanism locks the closed door. The compound latching mechanism, as the preferred door-operating mechanism, further includes a latching lever also mounted, preferably pivotally mounted, on the bottom margin of the door, and spring means mounted on the first lever and connected to the latching lever to provide a downward force on the latching lever, when the door is closed, for a locking engagement with locking means mounted on the supporting structure. Preferably the mechanism further includes means operatively connected to the first lever to provide against that lever, when it is in its first position, a sufficient force to prevent movement of that lever from the first position when the power means is closing the door.

18 Claims, 12 Drawing Figures

FIG. 6
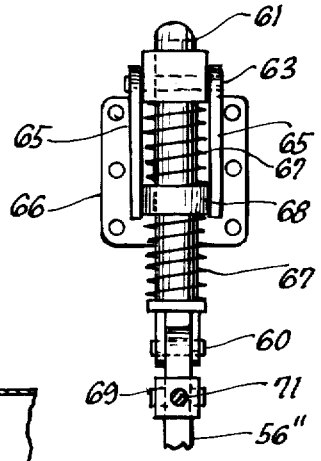
FIG. 5
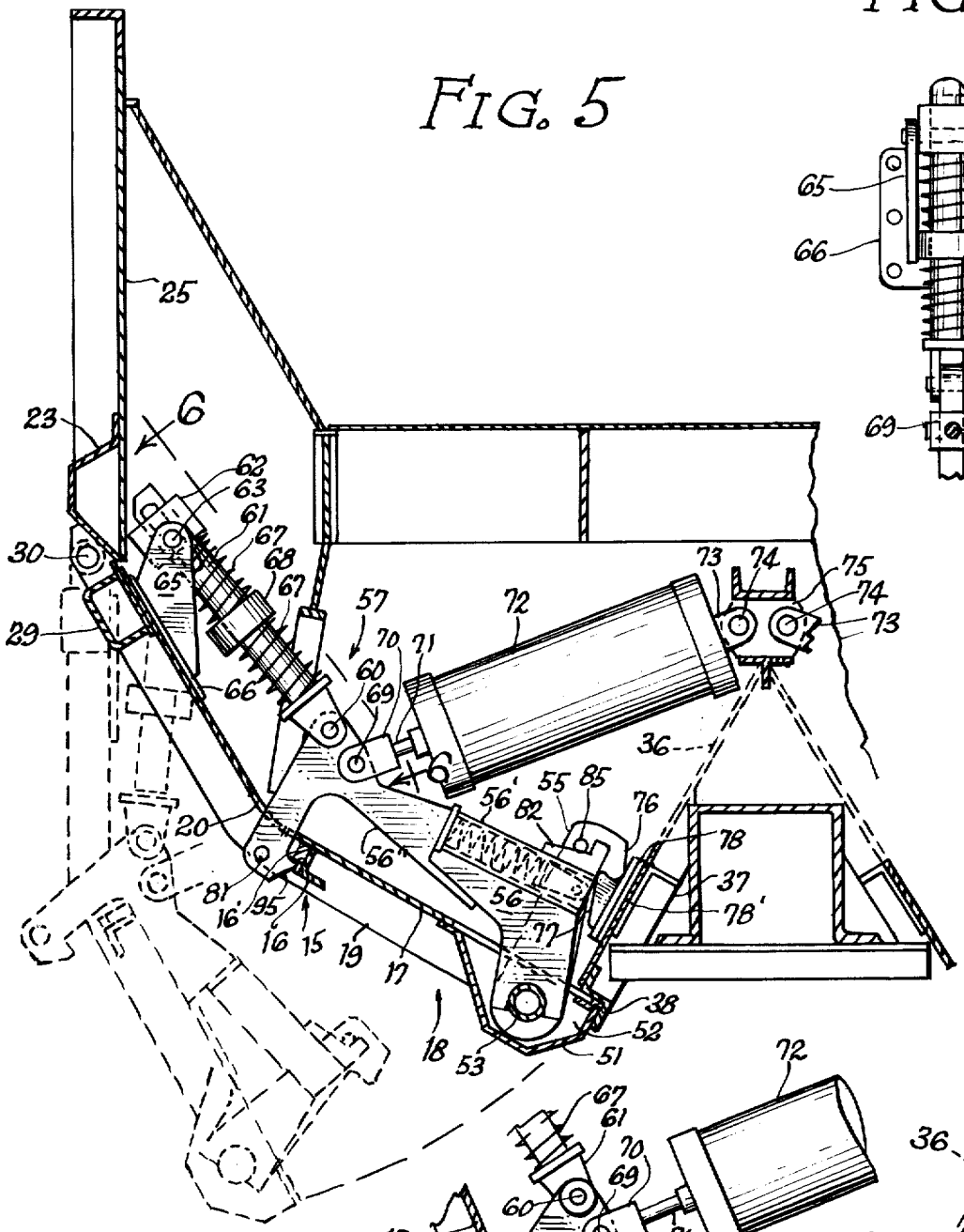
FIG. 7

HOPPER VEHICLE

BACKGROUND OF INVENTION

1. Field of the Invention

This invention relates to a bottom-opening hopper vehicle, especially a freight hopper car. The invention especially relates to side-opening, wrap-around hopper doors on opposite sides of the vehicle and door-operating, power-operated mechanisms for each of these doors to move them between open and closed positions.

2. Description of the Prior Art

The most pertinent prior art is the hopper vehicle disclosed and claimed in copending U.S. patent application Ser. No. 443,217, now U.S. Pat. No. 3,868,913, entitled "Hopper Vehicle" filed on Feb. 19, 1974, by us and Peter W. Becker and Carl E. Becker. That patent application is now allowed and its disclosure is hereby incorporated by reference in this patent applciation.

With respect to other prior art, reference is made to the description of the prior art appearing in that patent application in which there is specific reference to a book and patents. During the prosecution of that copending application other U.S. patents were called to the attention of the examiner. In addition there were four other U.S. patents cited by the examiner but none was deemed by him to affect the patentability of the claims of that copending patent application.

The hopper vehicle of the invention of said copending patent application has a construction that in many respects is the same as the construction of the hopper vehicle of the present invention. As is seen by a comparison of the summary of the invention of that patent application and by the detailed description of a preferred embodiment of the vehicle of that invention, incorporated herein by reference as mentioned above, with the summary of the invention and the detailed description of preferred embodiments, there is a difference between the hopper vehicle of the invention of that copending patent application and the hopper vehicle of the present invention. This difference in the preferred embodiment of the present invention resides primarily in the construction of the door-operating mechanism for each of the door assemblies of the vehicle.

Each door-operating mechanism of the hopper vehicle of that copending patent application includes a lever pivotally mounted at its bottom end on the bottom margin of said door assembly and having adjacent to its bottom end an extension that extends downwardly and toward the central plane of the vehicle and that is constructed to provide a latching lug. The lever is movable between a first position abutting the inside of said door assembly when the door is unlocked and a second position, when the door is closed, at which said extension is at its latching position to lock the closed door assembly. Each door-operating mechanism also includes power means mounted on support means of the supporting structure of the vehicle and operatively connected to said lever to provide a force on said lever in one direction for movement of said lever from said second position to said first position to unlock the door assembly (and subsequently in one preferred embodiment through said lever to provide part of the outer opening movement of said door assembly) and to provide a force in the opposite direction on said lever for return movement of said door assembly to its closed position and subsequent movement of said lever from said first position to said second position.

The door-operating mechanism of the vehicle of said copending patent application also has means operatively connected to said lever to provide against said lever, when in its first position, a sufficient force to prevent movement of said lever from said first position when the power means provides a force in said opposite direction greater than the force of gravity operating on the door assembly for movement of said door assembly to its closed position.

The hopper vehicle also has two locking means, preferably lugs, mounted on said supporting structure in alignment with said levers, each to be engaged by one of said latching lugs provided by said extensions of said levers after said door assemblies are closed and said levers have been moved to their second positions. The locking means and the latching lugs are constructed so that, when each of said levers is in its said first position and the door assembly on which it is mounted is being moved to said closed position, said latching lug clears said locking means with which it is engaged when said lever is moved to its second position after the door is closed.

A second embodiment of the present invention has the door-operating mechanism described above as the construction for the invention of said copending patent application, but the locking lug on each side of the vehicle is mounted on the supporting structure in a manner that it can be moved inwardly from its normal locking position, to which it is biased, in a direction toward the vertical longitudinal central plane of the vehicle in the event that the latching lug provided by the extension of the lever abuts the inclined surface of the locking lug as the door assembly is being closed. This striking of the locking lug by the latching lug could occur if the means connected to said lever to maintain it at its first position while the door is being closed becomes inoperative. In the event of that inoperativeness the lever would be pivoted away from its first position by the power means, when it is providing the force to close the door, so that the latching lug would no longer be in a position to clear the locking lug. This undesirable movement of the lever from its first position at that time does not prevent a closing of the door in this embodiment of the present invention because of this movable mounting of the locking lug whereby, due to its movement inwardly, the latching lug, as the extension of the lever, slides along the inclined outer surface of the inwardly-moved locking lug until the latching lug is beyond the locking lug. Then the locking lug returns to its normal position to which it is biased by means, such as spring means, constituting a part of its mounting means on the supporting structure.

As seen in the disclosure of said copending patent application, incorporated by reference as mentioned above, the vehicle of that invention has preferably an opening in alignment with the top portion of the lever of the door-operating mechanism through which passes an angular extension of the top portion of the lever for the purpose described in that copending application. Furthermore, the preferred construction provides for three-point locking of each door assembly. The lever of each door-operating mechanism is fixedly mounted on torsion means that is rotatively mounted on the bottom margin of the door assembly and horizontally extends from one end of the door assembly to the other end. At the ends of the torsion means that extends from one end of the door assembly to the other end there are mounted latching arms that pivot with the pivotal movement of said lever and when the latter is in its second position these latching arms at the ends of the torsion means engage keepers, i.e., locking lugs mounted on the supporting structure of the vehicle.

A preferred construction of each door-operating mechanism is a construction in which the lever of the door-operating mechanism is a first lever of a toggle assembly. The second lever of the toggle assembly is pivotally connected at one end to the end of the first lever that is not pivotally mounted on the door assembly. The other end of the second lever is pivotally mounted on support means fixedly mounted on the top margin of the door assembly. That support means is constructed to permit axial movement of the second lever. Spring means is mounted on the second lever between that support means and an intermediate portion of the second lever to bias the second lever in a direction away from the pivotal axis of mounting of the second lever on that support means. The spring means thereby constitutes the means operatively connected to the top portion of the first lever to provide the sufficient force against the first lever when it is in its first position to prevent movement of that lever from that position while the power means is moving the door assembly to the closed position. When the first lever is at its first position, the toggle assembly is in a nonlocking overcenter condition that is one side of the plane at which all three pivot axes of the toggle assembly are centered, i.e., in alignment. When the first lever is at its second position, the toggle assembly is in a locking overcenter condition on the other side of that plane. The first overcenter condition is the more important one for utilization of the spring bias action as the spring has sufficent force to maintain the first lever at its first position until the power means through the first lever has completed the pulling of the door assembly toward the closed position.

The first lever of each toggle assembly is pivotally connected to the respective rod of air cylinders constituting the preferred power means for each door assembly. The toggle assembly is also constructed so that it is in the nonlocking overcenter condition until the piston rod is retracted sufficiently to close the door and is then moved to its locking overcenter condition as the piston rod is further retracted. The spring means is always compressed to some extent. The lower portion of the first lever of the toggle assembly is constructed with an extension providing an integral latching lug that, when the door is closed and the piston rod is further retracted, engages a locking lug mounted on the supporting structure of the vehicle, as described earlier.

When the first lever of the toggle assembly is fixedly mounted on a torsion bar linkage that is rotatably supported by the bottom margin of the door and that extends longitudinally in opposite directions, there are latching arms fixedly mounted on the free ends of the torsion bar linkage. Keepers, i.e., locking lugs, are mounted on the supporting structure of the car to be engaged by those latching arms when the door is closed. The overall construction provides an overcenter latching at the ends of the doors when the torsion bar linkage turns the latching arms to engage the corresponding keepers due to the movement of the toggle assembly to its second overcenter condition by the last part of the retraction of the piston rod.

Summary of the Invention.

The preferred construction of the hopper vehicle of the present invention differs from the hopper vehicle of said copending patent application primarily in the construction of the door-operating mechanism for each door assembly of the vehicle. In another construction, the difference is primarily in the use of spring means for the mounting of the locking lug that is engaged by the latching lug of the door-operating mechanism.

The improved construction of the door-operating mechanism or of the mounting means for the locking lug of the present invention makes it possible to close and lock the door assembly even though, during service use of the vehicle, the means, that is operatively connected to the lever to provide the sufficient force that prevents movement of that lever from its first position abutting the inside of the door assembly when the power means provides a force to close the door assembly, may become inoperative. For example, the preferred construction of that means connected to the lever to provide such sufficient force constitutes spring means and the spring may be broken after repeated opening and closing of the door assembly. In that case, the lever, which is the first lever of the toggle assembly of that preferred construction, is pivoted away from its abutment against the inside of the door assembly prior to the power means moving the door assembly toward the closed position. This pivotal movement of the lever of the door-actuating mechanism of said copending patent application places its extension, that constitutes the latching lug, in a position so that it abuts the fixed locking lug when the door assembly is moved toward closed position. As a result, the door cannot be completely closed and, of course, not locked. The door-operating mechanism or the movably-mounted locking lug of the present invention avoids this undesirable result if and when such spring means becomes inoperative during service use.

The rest of this summary of the invention and the detailed description and drawings are directed to the construction in which there is the novel door-operating mechanism.

As seen from the summary of invention and from the detailed description of the preferred embodiment that follow, it is possible to have a door-operating mechanism that does not include means connected to the lever that prevents the movement of that lever from the first position when the door is being closed. However, it is preferred that such means be a component of the door-operating mechanism. It is especially preferred that such means, as a component of the door-operating mechanism, constitutes spring means operative on said lever in a construction in which that lever is a part of a toggle assembly. This construction with the spring means is especially preferred because the toggle assembly is in one of its overcenter conditions when the door is open.

The hopper vehicle of the present invention has a pair of bottom hoppers extending lengthwise of the vehicle on opposite sides of the vertical central plane of the vehicle. The vehicle comprises a supporting structure and a body structure. The supporting structure includes support means extending from about one end of the vehicle to about the other end of the vehicle and located at the bottom portion of the vehicle for mounting on wheeled assemblies of the vehicle. The body structure includes end walls; side walls; an inverted generally V-shaped panel extending lengthwise of the vehicle and mounted on said support means to provide a part of two hoppers of said vehicle; and a door assembly (sometimes herein referred to simply as a door) hingedly mounted at its upper margin on each of said side walls to swing outwardly and constructed to provide the balance of one of said two hoppers of the vehicle.

The hopper vehicle further includes a door-operating mechanism for each of said door assemblies and located intermediate the length of the door assembly. Each of said door-operating mechanisms includes a latch assembly and power means that is mounted on said support means. The latch assembly comprises a lever, a latching arm and spring means mounted on said lever and connected to said latching arm provide a biasing force in a direction that resiliently urges the distal end portion of the latching arm in a direction away from the said lever. The lever and the latching arm are constructed to limit this movement of the distal end portion of the latching arm due to the bias force of the spring means. The lever of said latch assembly is pivotally mounted at its bottom end on the bottom margin of said door assembly for movement between a first position abutting the inside of said door assembly when the door is unlocked and a second position spaced from inside of said door assembly when the door is closed. The latching arm is also pivotally mounted at its other end on the bottom margin of said door assembly in a manner to pivot relative to said lever but this relative movement in the direction away from said lever is limited by the construction of said lever and said latching arm, as mentioned above. That construction also is such that whan said lever is pivotally moved from said second position, said lever pivotally moves said latching arm in the same direction.

The distal end portion of the latching arm of each of said door-operating mechanisms has a lateral extension toward the vertical central plane of the vehicle. Thus the latching arm with this lateral extension is a hook arm. These extensions of the arms engage two locking means, preferably lugs, mounted on said supporting structure in alignment with said arms. Each of these latching arms has its extension engaging one of said locking lugs after said door assemblies are closed and the associated one of said levers has been moved to its said second position.

By virtue of the foregoing construction of each of said latch assemblies, said latching arm is in locking position engaging the associated locking lug when the door is closed and said lever is at its said second position. Said spring means helps to maintain this locking engagement of said latching arm with said locking lug even if said power means becomes inoperative to maintain said lever at said second position.

When said power means moves said lever from said second position for the purpose of unlocking said door assembly, this pivotal movement of said lever, in view of its construction and that of said latching arm, provides a pivotal movement in the same direction of said latching arm to move it from locking engagement with said locking lug so that said door assembly swings open due to its weight and the weight of any load of material in the hopper vehicle. The construction of said latch assembly is such that this unlocking movement of said latching arm of said latch assembly and of said end latching arms occurs by the time that said lever has been pivotally moved by said power means to said first position of said lever at which that lever abuts the inside of said door.

The power means of each door-operating mechanism is operatively connected to said lever of said latch assembly to provide a force on that lever in one direction for movement of said lever from said second position to said first position to unlock the door assembly, as described above, and subsequently in one embodiment to provide through said lever part of the outer opening movement of said door assembly. The power means is thus operatively connected to said lever to provide also a force in the opposite direction on said lever for return movement of said door assembly to its closed position.

In the event that said latch assembly is constructed in the preferred manner, as described later, to include certain additional components, the force provided by said power means to close the door will not move said lever from said first position until the said door assembly is completely closed. In that case, with said lever thus maintained at said first position by the presence of these additional components, said lever prevents movement of said latching arm of said latch assembly, otherwise provided by force of said spring means of said latch assembly, from the preferred position relative to said door assembly such that the latching arm of said latch assembly clears said locking lug, with which it is associated, until said door assembly is completely closed. After the closing of said door assembly, said power means in that preferred construction pivotally moves said lever from said first position to said second position and said lever moves said spring means mounted on said lever and connected to said latching arm of said latch assembly resulting in a pivotal movement of that latching arm to a locking position at which it engages said locking lug. That spring means helps to maintain that latching arm in the locking position.

The additional components that provide, in this preferred construction, the maintenance of said lever at said first position during the closing of the door comprise means operatively connected to said lever to provide against said lever, when in its first position, a sufficient force to prevent movement of said lever from said first position when said power means moves said door assembly to its closed position by providing a force that is greater than the force of gravity acting on said door assembly. In its broadest aspect the door-operating mechanism of the present invention does not require such means to prevent movement of said lever from said first position during the closing of the door by said power means, because said latch assembly is a combination of a lever, a latching arm and a spring means mounted on said lever and connected to the latching arm with a particular structural arrangement of these components. In this case, there is freedom for movement in the opposite direction of arm of said latching assembly when said lever is pivotally moved in a direction from its first position to its second position during the closing of said door assembly. This freedom for movement permits the distal end portion of said latching lever to ride over the associated locking lug and thereby permits the completion of the closing of said door assembly by the closing force applied by said power means to said door assembly through said latch assembly. This ability to close said door assembly, due to the construction of said latch assembly without the additional components, that would maintain said lever at its first position during the closing of the door, is useful in the preferred construction because said additional components during service use of the vehicle may become inoperative and in such event said door assembly can still be closed and locked.

For each door-operating mechanism the vehicle includes stop means to limit the movement of said lever from the first position during the closing of the door assembly so that said lever is not pivoted beyond a position at which the latch assembly would interfere with the closing of the door. In the preferred construction said stop means is mounted on said door assembly. In this case the top portion of said lever has an angular extension that is directed toward and through an opening in said door assembly. That opening is, of course, in alignment with said top portion of said lever of said door-operating mechanism. This angular extension is preferably present also for the purpose of moving said lever from said second position to said first position to unlock the door assembly from a position outside the vehicle. That movement disengages the latching arm of the latch assembly from the locking lug. To this extent the construction of the extension of said lever is that shown in the preferred embodiment of construction of the hopper vehicle of said copending patent application.

In this preferred aspect of the hopper vehicle of the present invention in which said stop means is present, the distal end portion of said angular extension of said lever has a lateral extension that abuts said stop means when said lever is pivotally moved to said second position during the closing by force applied by said power means to said lever, in the event said additional components that would prevent at that time this pivotal movement of said lever, are absent or those components, when present, have become inoperative. As a result of said lever abutting said stop means, said latching arm of said latch assembly cannot be pivotally moved by said spring means mounted on said lever to a position that would prevent that latching arm from riding over said locking lug during the closing of said door assembly.

This application of closing force against said stop means mounted on said door assembly is especially important in the preferred illustrative construction described later for a three-point locking of said door assembly. This is because, in the preferred construction of said latch assembly, said lever is pivotally mounted in a straddling manner on torsion bar means on which said latching arm is fixedly mounted. The torsion bar means is rotatably mounted on the bottom margin of said door assembly. In that case the presence of said stop means and said lateral extension of said angular extension of said lever prevents a movement of said lever from its straddling position on said torsion bar means that could prevent pivotal movement of said latching arm as required to ride up and over said locking lug during the final closing of said door assembly.

In the preferred construction that provides for three-point locking of each door assembly, the latching arm of each door-operating mechanism is fixedly mounted on torsion means that is rotatably mounted on the bottom margin of the door assembly and extends horizontally from one end of the door assembly to the other end. As seen below in the description of the preferred embodiment of the vehicle as a freight hopper car, this torsion means can be formed of three components connected to one another with the intermediate component being a connecting tube, on which the latching arm of said latch assembly is fixedly mounted, and the other two components are torsion bars fixedly mounted on the end portions of that connecting tube. At the ends of the torsion means that extends from one end of the door assembly to the other end there are fixedly mounted latching arms that pivot with the pivotal movement of said lever and thus said latching arm of said latch assembly, and when said lever is at its second position these latching arms at the ends of the torsion means engage keepers, i.e., locking lugs, mounted on the supporting structure of the vehicle. The lever of said latch assembly is pivotally mounted on said torsion means.

In this preferred construction the torsion means, i.e., torsion bar linkage, which interconnects the end latching arms with the latching arm of said latch assembly and thus to said power means, is within a horizontal reinforcing member or chord mounted on the bottom margin of the door panel of the door assembly to provide support for the torsion bar linkage that provides pivotal movement of said end latching arms in concert with the pivotal movement of said latching arm of said latch assembly.

The preferred construction of the hopper vehicle of the present invention has the additional components, mentioned above, of said latch assembly to provide means that maintains a sufficient force against said lever, when it is in its first position, to prevent movement of that lever from that position while said power means is moving said door assembly to the closed position. These additional components include a second lever and second spring means. In this construction said lever connected to said power means is a first lever of a toggle assembly and said second lever is the other lever of said toggle assembly. The second lever is pivotally connected at one end to the distal end portion of said first lever, that is, the end portion that is not pivotally mounted on said door assembly. The other end portion of said second lever is pivotally mounted on support means fixedly mounted on the top margin of said door assembly. The support means and that end portion of said second lever are constructed to permit axial movement of said second lever. The second spring means is mounted on said second lever between said support means and intermediate portion of said second lever to bias said second lever in a direction away from the pivotal axis of mounting of said second lever on said support means. The spring means thereby constitutes said means operatively connected to the top portion, i.e., distal end portion of said first lever to provide the sufficient force against said first lever when it is in its first position to prevent movement of that lever from that position while said power means is moving said door assembly to the closed position.

When the first lever is at its first position, the toggle assembly is in a nonlocking overcenter condition that is one side of the plane at which all three pivot axes of the toggle are centered, i.e., in alignment. When the first lever is at its second position, the toggle assembly is in a locking over-center condition on the other side of that plane. The first overcenter condition is the more important one for utilization of the spring bias action as the second spring means has sufficient force to maintain the first lever at its first position until the power means through the first lever has completed the pulling of the door assembly toward the closed position.

In the preferred embodiment of the door-operating means the power means comprises a pair of power cylinders, e.g., air cylinders, extending in opposite directions in a transverse plane and pivotally mounted on the longitudinal support means. The first lever of each toggle assembly is pivotally connected to the respective rod of the cylinders. The toggle assembly is also constructed so that it is in the nonlocking overcenter condition until the piston rod is retracted sufficiently to close the door and is then moved to its locking overcenter condition as the piston rod is further retracted. The spring of said second spring means is always compressed to some extent, as is the case for said spring means mounted on said first lever and connected to said latching arm of said latch assembly. On the lower portion of the first lever of the toggle assembly is mounted said first spring means that is connected to said latching arm as described earlier, so that, when the door is closed and the piston rod is further retracted, said latching arm engages said associated locking lug mounted on the fixed body structure, as described earlier.

When the first lever of the toggle assembly is fixedly mounted on a torsion bar linkage that is rotatably supported by the bottom margin of the door and that extends longitudinally in opposite directions, there are latching arms fixedly mounted on the free ends of the torsion bar linkage. Keepers, i.e., locking lugs, are mounted on the body structure of the car to be engaged by those latching arms when the door is closed. The overall construction provides an overcenter latching at the ends of the doors when the torsion bar linkage turns the end latching arms to engage the corresponding keepers due to the movement of the toggle assembly to its second overcenter condition by the last part of the retraction of the piston rod.

DESCRIPTION OF DRAWINGS

FIG. 5 is a fragmentary cross section of the car taken along line 5—5 of FIG. 1, showing one of the especially preferred embodiments of the construction of the freight hopper car and showing in phantom the fully open position of the door assembly.

FIG. 6 is a fragmentary view taken along line 6—6 of FIG. 5.

FIG. 7 is a fragmentary cross section that is like FIG. 5 except that it illustrates, while the door assembly is being closed, the operation of the latch assembly after the spring mounted on the second lever of the toggle assembly has broken and thus has become incapable of maintaining the first lever of the toggle assembly, connected to the air cylinders, at its first position abutting the inside of the door assembly.

DETAILED DESCRIPTION

Figure 1:
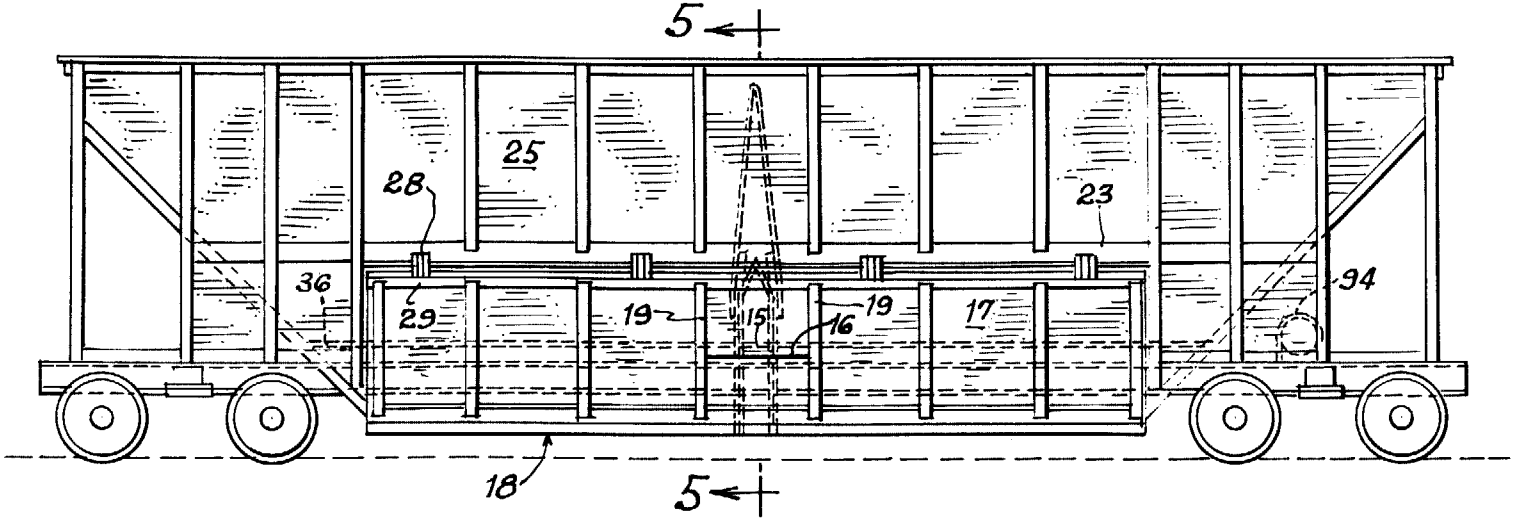
FIG. 1 is a side view of a freight hopper car that is the preferred embodiment of the hopper vehicle of the invention and represents a side view of two especially preferred embodiments of the freight hopper car.

The freight hopper car shown in FIG. 1 has for its supporting structure and body structure the components in the freight hopper car disclosed in said copending patent application that has been expressly incorporated in this patent application. For this reason, generally most of these components will not be described below, except some in connection with the door-operating mechanism and the door assembly.

Figure 8:
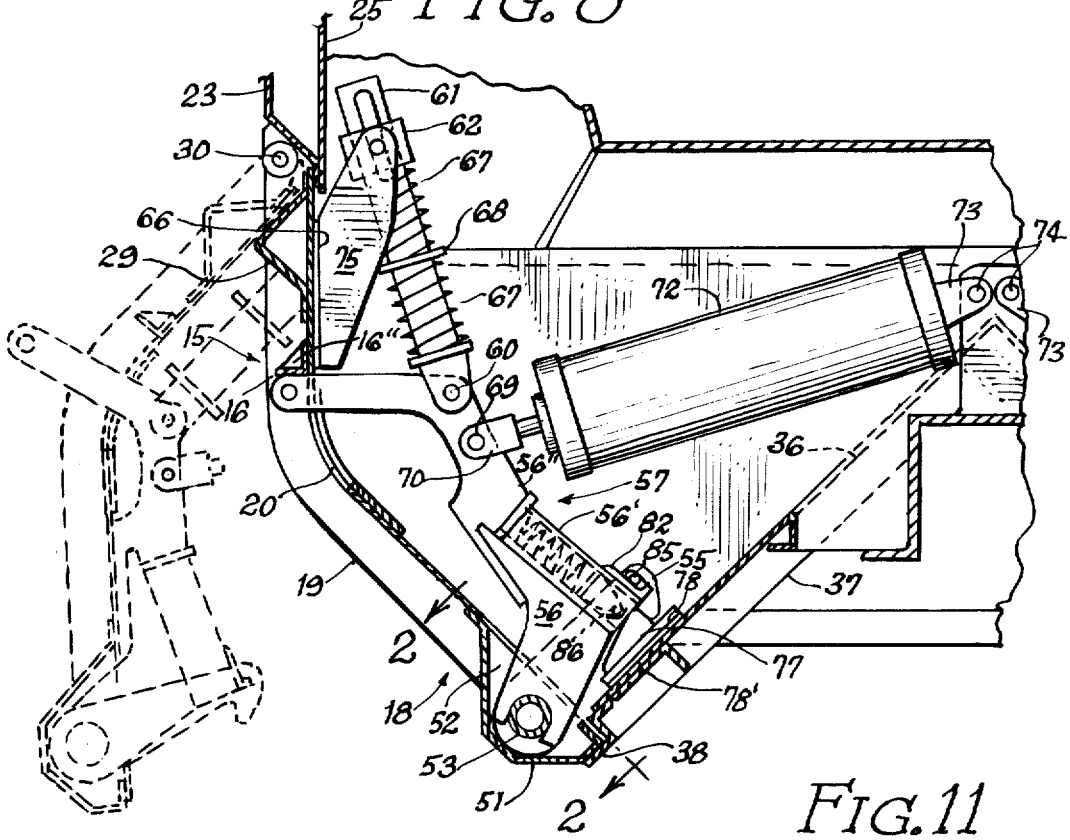
FIG. 8 is a fragmentary cross section of the freight car, like FIG. 5, showing another especially preferred embodiment of the freight hopper car shown in FIG. 1, and showing in phantom the fully open position of the door assembly.
Figure 9:
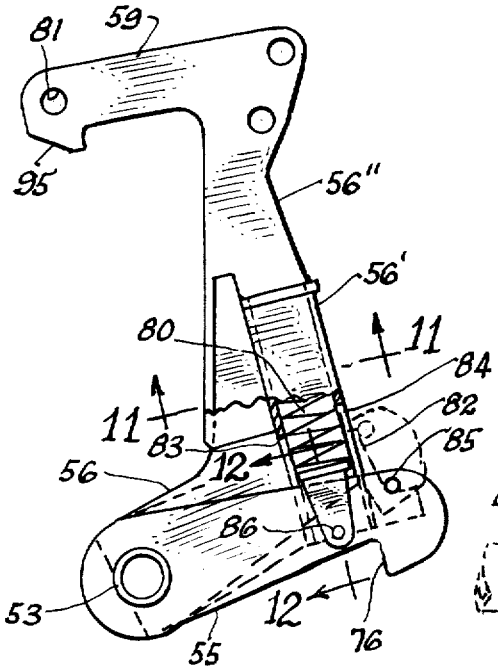
FIG. 9 is an enlarged view, partially broken away, of the latch assembly of the invention showing in phantom the position of the latching arm of that assembly when it is pivoted by the associated latching lug as the arm rides over it, as shown in FIG. 7, to permit completion of the closure of the door.
Figure 10:
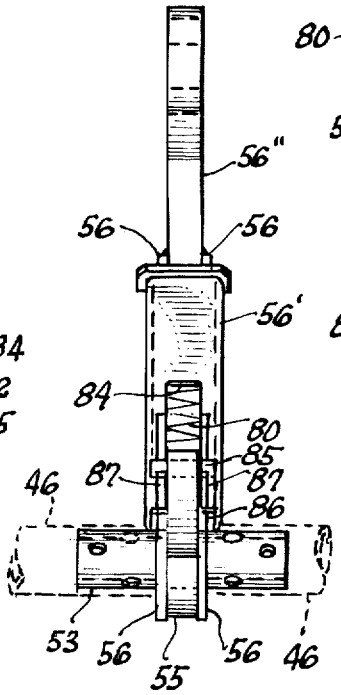
FIG. 10 is a view of the latch assembly as seen from the right of FIG. 9 and shows in phantom the torsion bars that extend to the ends of the door assembly.
Figure 11:
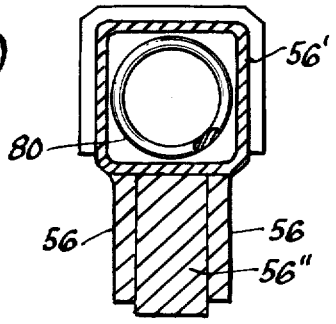
FIG. 11 is a view taken along line 11—11 of FIG. 9.
Figure 12:
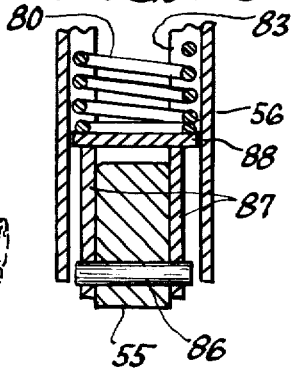
FIG. 12 is a view taken along line 12—12 of FIG. 9.

The hopper car to the extent shown in FIG. 1 differs from that shown in FIG. 1 of said copending application by a showing of stop means generally indicated at 15 that includes horizontal angle iron 16 mounted on a panel 17 of a hopper door assembly generally indicated at 18 that extends lengthwise of the car. The angle iron 16 is secured at its ends to door stiffeners 19 of door assembly 18. The panel 17 has a central opening 20 (FIGS. 5, 7 and 8). In the embodiment of FIG. 5, angle iron 16 is just below opening 20 and rigidly supports a notched stop block 16' of stop means 15 at the bottom margin of opening 20. In the embodiment of FIG. 8, angle iron 16 without block 16' is stop means 16. It is mounted at the top edge of opening 20 and is strengthened by gussets 16''. As in the construction of the car of said copending application, door assembly 18 has additional door stiffeners (not numbered). Of course, each side of the car has door assembly 18 and an associated door-operating mechanism, as described below for one side of the car.

As in the case of the car of said copending patent application, the car of each of the two especially preferred embodiments has on each side of the car an upper intermediate side sill 23. The hopper door assembly 18 at its upper portion forms a part of that side of the car. This is apparent from FIG. 8 that shows one of the especially preferred embodiments in which the upper portion of panel 17 is vertical and essentially in alignment with side panel 25 that constitutes a fixed side wall of the body structure of the car. The side panel 25 and the upper portion of door panel 17 thus constitute one side of the car. The construction of door assembly 18 shown in FIG. 8 has a wrap-around configuration with the bottom portion directed downwardly and inwardly toward the vertical central plane of the car. Thus the bottom portion of door assembly 18, as in the case of the door assembly in the car that is disclosed in said copending patent application, provides one part of a hopper on that side of the car. In use door assembly 18, when fully opened to provide a large opening for discharge of material from the hopper car is outside of the longitudinal vertical plane at which side panel 25 is located. This construction for a wide opening of door assemblies 18 on both sides of the car is preferred to insure a discharge of material from the car beyond the rails on which the car rides instead of between the rails as is the case with constructions of hopper cars prior to the construction of the hopper car of said copending patent application and that of the present invention. Such construction of the present invention requires adequate clearance between the hopper car and adjacent construction, such as a building alongside the track, at the location where the car is unloaded.

At some unloading locations there is insufficient clearance between the hopper car and fixed structure alongside of the track. Because of this, the present invention includes a hopper car in which door assembly 18 has a modified construction that is shown in FIG. 5. In that case, door assembly 18 although also having a wrap-around configuration is mounted and constructed in cooperation with the other component, that forms the other part of the two hoppers of the car, so that the top portion of door assembly 18 provides a lower part of the side of the car that extends downwardly and inwardly from the bottom end of side panel 25. As in the construction of FIG. 8 the bottom portion of door assembly 18 provides one part of the hopper on that side of the car. In this construction (FIG. 5), when door assembly 18 is opened to the position at which the top portion of door assembly 18 is in vertical alignment with side panel 25, there is a substantial opening of the hopper and yet there is practically no requirement for clearance alongside the car while it is being unloaded.

As in the case of the hopper car of said copending patent application, the hopper car, being described for the two especially preferred embodiments, has a supporting structure including support means extending from about one end of the vehicle to about the other end of the vehicle and located at the bottom portion of the vehicle for mounting on wheeled assemblies of the vehicle. The car also has a body structure including end walls and side walls comprising side panels 25 and door assemblies 18 on each side of the car. Each of door assemblies 18 on the two sides of the car provides one side of one of the two hoppers.

Each door hopper assembly 18 is pivotally mounted on an upper intermediate side sill 23 on a side of the car by a number of hinge assemblies 28 shown somewhat schematically in FIG. 1. Each of hinge assemblies 28 includes a number of hinge lugs mounted on side sill 23 and others mounted on the upper chord 29 of door assembly 18. Through each of these two sets of lugs is passed a hinge pin 30 (FIGS. 5 and 8) that is held in place with a cotter key (not shown). For each side of the car, pins 30 are in alignment and provide the pivotal axis for movement of door assembly 18.

In view of the foregoing description, it is apparent that door assemblies 18 provide part of the floor of the body of the car. The balance of the floor is provided by two inverted V-shaped panels 36 that extend, in alignment with each other, lengthwise of the car from sloping end panels (not numbered) of the end walls of the car. The panels 36 are supported on the center sill (not numbered) of the car. The ends of V-shaped panels 36 are suitably shaped to abut the sloping end panels to which they are connected. The other ends of panels 36 extend to and are connected to a shield (not numbered) that is at central transfer zone of the car. The shield has the construction disclosed in detail in the incorporated disclosure from said copending patent application. That shield prevents ingress of material, loaded in the car, into the zone containing the door-operating mechanism. As seen in FIGS. 5 and 8, when door assemblies 18 are closed the bottom portions of these doors provide with V-shaped panels 36 at least part of the floor of the car. Thus the floor has two lengthwise hoppers that are on opposite sides of the central axis of the car.

The panels 36 in the embodiment of FIG. 5 have a smaller included angle than in the construction shown in FIG. 8 so that door assembly 18 in the embodiment in FIG. 5 when closed has its distal end closer to the longitudinal axis of the car than in the construction in FIG. 8. This construction is for the purpose of permitting the door to be opened to an adequate extent without requiring substantial clearance between the car and structure alongside the track at an unloading station.

The body structure of the car on each side of the center sill includes a number of reinforcing members 37 (FIGS. 5, 7 and 8) that are supported by the center sill at various longitudinally spaced locations. The reinforcing members 37 extend downwardly and outwardly toward one or the other side of the car. The ends of V-shaped panels 36 are supported by the sloping end panels mentioned above. The panels 36 are stiffened by reinforcing members 37 that are below panels 36.

On each side of the car there is a Z-shaped bar 38 that is mounted on the bottom ends of reinforcing members 37 on that side of the center sill. Each bar 38 extends the length of door assembly 18 and serves as a bottom stop for door assembly 18. The structure of the car also includes, for each side, a pair of members (not shown) that are abutted by the ends of door assembly 18 when it is closed. Each of these pair of members is mounted on a supporting structure that includes a plate (not shown) at the bottom of which there is also mounted a plate 41 that supports a locking lug assembly generally indicated at 42. For the construction of the pair of members and the plate that are not shown, reference is made to the incorporated drawings of said copending patent application. The assembly 42 includes a locking lug base plate (not shown) mounted on plate 41. Adjustably mounted on said locking lug base is a keeper or locking lug 44 that has an extension with a cam surface to be engaged by a latching lug or arm 45 fixedly mounted on a torsion bar 46 of door assembly 18.

Figure 4:
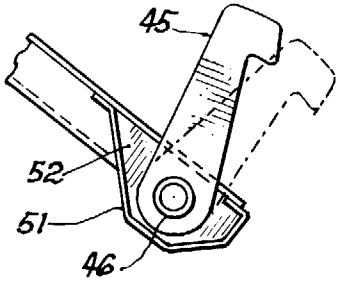
FIG. 4 is a fragmentary end view of the side-opening door assembly shown in FIG. 1.

Each door assembly 18 includes door panel 17 that extends the full length of the door. The upper chord 29 of door assembly 18 is mounted on the outside surface of the top margin of panel 17. A lower chord 51 extends the length of panel 17 and is mounted on the bottom margin of panel 17. Each door assembly 18 has a pair of torsion bars 46 that are shown as tubes. The bars 46 extend in opposite directions from a central zone of the door. Each torsion bar 46 is rotatably mounted within bottom chord 51. Each torsion bar 46 is supported adjacent its ends by a bearing plate 52 mounted on lower chord 51 by means not shown. Each torsion bar 46 extends beyond the corresponding end of bottom chord 51 and latching arm or lug 45 is fixedly mounted on that end portion, as seen in FIG. 4.

Figure 2:
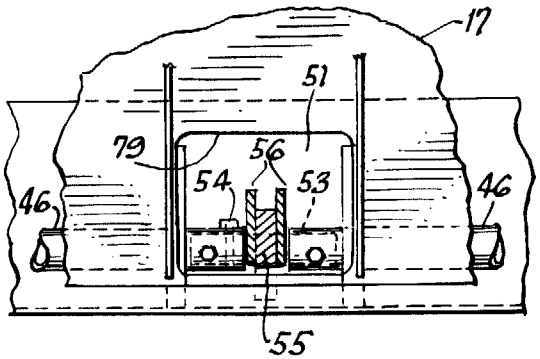
FIG. 2 is a fragmentary cross section taken along line 2—2 of FIG. 8.
Figure 3:
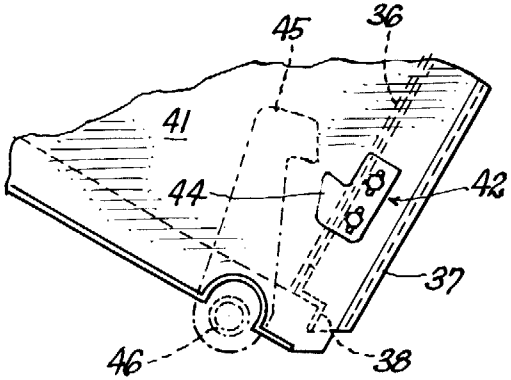
FIG. 3 is a fragmentary cross section of the car shown in FIG. 1 taken at one end of the door opening of the car to show the construction and mounting of one of the end locking lugs and showing in phantom the corresponding end latching arm and one of the torsion bars of the torsion means rotatively mounted on the bottom margin of the door on that side of the car.

As seen in FIG. 2, the other end of each torsion bar 46 is fixedly mounted on an end portion of a connecting tube 53 by bolts 54 and nuts (not shown). The rotation of connecting tube 53 causes rotation of both torsion bars 46. The connecting tube 53 extends through a hole at one end portion of a latching arm 55 that is fixedly mounted on tube 53 for pivotal mounting of arm 55. When arm 55 is pivoted, tube 53 and thus bars 46 are turned about their common axis.

Two spaced plates 56 of a first lever of a toggle assembly generally indicated at 57 are mounted at one of their ends on tube 53 for pivotal movement relative to tube 53 and thus relative to latching arm 55. The pair of plates 56 are on opposite sides and spaced from latching arm 55. The other or distal end portions of the pair of spaced plates 56 are fixedly connected to one side of a square tube 56'. The distal end portion of each of the pair of spaced plates 56 has a lateral extension that is also fixedly connected to that side of tube 56' as a continuation of the connection of plates 56 to tube 56'. These spaced lateral extensions of plates 56 are on opposite sides of and fixedly connected to a plate 56'' that has at one end a notched portion with an edge that is coplanar with the edges of the lateral extensions of plates 56. The plate 56'' at that edge is also connected to that side of tube 56'. The tube 56' is closed at its end remote from latching arm 55 and that closed end is connected to plates 56 and to plate 56'' at the other edge of its notched portion.

The opening 20 at the center of door panel 17 is at the transverse plane of the car passing through plate 56''. An angular extension 59 of plate 56'' passes through opening 20. This extension 59 is at the other end portion of plate 56''. The pair of spaced plates 56, tube 56' and plate 56'' constitute one lever of toggle assembly 57.

The end of plate 56'', that has the angular extension, is connected by a pin 60 to the clevis end of the other lever 61 of toggle assembly 57. Except for the clevis end of lever 61, the rest of its length is a cylindrical rod that has a longitudinal slot adjacent its distal end. A spring retainer block 62 has a central hole through which passes the distal end portion of lever 61. The block 62 has a transverse hole through which passes a pin 63 that passes also through the longitudinal slot at the distal end portion of lever 61. The ends of pin 63 are mounted on a pair of spaced brackets 65 that is mounted on a support plate 66 bolted through door panel 17 to upper chord 29, so that bracket 65 extends inwardly of the car from the top margin of panel 17. By this construction lever 61 of toggle assembly 57 is mounted on the top marginal portion of door assembly 18 for pivotal movement and for axial movement. There are two springs 67 mounted on lever 61 between its clevis end and spring retainer block 62. A wearplate 68 is mounted on lever 61 between springs 67.

The other end portion of plate 56'' of said first lever of toggle assembly 57 that is pivotally connected to lever 61 has another hole in which is mounted a pin 69. The end portions of pin 69 are in holes of a clevis 70 mounted on the free end of a piston rod 71 of an air cylinder 72 that extends transversely of the car and is pivotally mounted at its other end by its clevis 73 through which extends a pin 74 on a support bracket 75 that is mounted above the center sill of the car. By this construction air cylinder 72 can pivot at the axis of the pin 74 that is parallel to the longitudinal axis of the car so that axial movement of piston rod 71 will provide pivotal movement of plate 56'' of the first lever of toggle assembly 57. This provides arcuate movement of tube 56' and provides pivotal and axial movement of lever 61.

The lever 61 is pivotally connected to the top margin of door assembly 18. The first lever, that comprises plates 56, tube 56' and plate 56'', is pivotally connected to the bottom margin of door assembly 18 by virtue of plates 56 pivotally straddling connecting tube 53. Thus the two levers constitute toggle assembly 57 that is pivoted at pin 60 when there is relative pivotal movement.

The latching arm 55 has, at its distal end portion, an angular extension 76 that constitutes an integral latching lug of arm 55. This angular extension is toward the vertical central plane of the car. Thus latching arm 55 with its angular extension 76 is a hook arm. A locking lug 77 for each door assembly 18 is adjustably bolted on a plate 78 that is fixedly mounted on a slope sheet 78' mounted on the supporting structure of the car. When door assembly 18 is fully closed and piston rod 71 is sufficiently retracted, angular extension 76, as a latching lug, of arm 55 engages locking lug 77 to provide a locking of door assembly 18. At that time, toggle assembly 57 is at its locked overcenter condition, i.e., overcenter to the right as viewed in FIG. 5 and FIG. 8. The arm 55 is maintained in this position by a spring 80 while toggle assembly 57 is in this locked overcenter condition in a manner described later.

When door assembly 18 is fully closed and locked, it is not necessary to maintain the retraction force on piston rod 71 to maintain the locking of door assembly 18. Air cylinder 72, and thus its piston rod 71, and springs 67 could fail simultaneously and yet door assembly 18 would remain closed and locked. This is because the geometry of the bearing surfaces of latching extension 76 of arm 55 and locking lug 77 is such that when they are engaged, they will maintain door assembly 18 in a closed position. The same is true for the geometry of the bearing surfaces of latching arms 45, at the ends of door assembly 18, and locking lugs 44. This geometry of these bearing surfaces is such that the load in the car that acts on door assembly 18 does not tend to unlock these engaged bearing surfaces. Of course, this locked overcenter condition of toggle assembly 57 is assured by springs 67 on lever 61 that inhibit the pivotal movement of the first lever, i.e., plate 56'', tube 56' and plates 56, of toggle assembly 57.

It is seen that there is a three-point locking. The locked overcenter condition of toggle assembly 57 assists in retaining latching arms 45 and latching arm 55 in their locked positions by proper positioning of the first lever and thus spring 80 to maintain arm 55 in its locked position.

The door panel 17 has a bottom opening 79 midway its length. The arm 55 that is fixedly mounted on connecting tube 53 extends through this opening. The spaced plates 56 pivotally mounted on tube 53 also extend through opening 79. The extension 76, that serves as a latching lug for arm 55, is inwardly of door panel 17 so that it can engage locking lug 77. The lug 77 can be adjusted upwardly or downwardly on slope sheet 78' to insure a satisfactory locking engagement between latching arm 55 and locking lug 77 when piston rod 71 is sufficiently retracted.

The lateral extension 59 of plate 56'' has at its distal end portion outside door panel 17 a hole 81. In the event that it is desired to manually operate toggle 57 for unlocking door assembly 18, a rod (not shown) can be inserted in hole 81 and that rod would be manually pulled. Alternatively, extension 59 can be grasped and pulled by a power-operating device.

On the side of square tube 56' opposite to that to which plates 56 are connected there is mounted a pair of generally L-shaped lifter plates 82. The plates 82 are parallel to the pair of plates 56. Extending from the bottom of these two sides of square tube 56' are longitudinal slots 83 and 84 that are parallel to and between plates 56 and between lifter plates 82, respectively. The latching arm 55 extends through slots 83 and 84 so that the distal end of arm 55 and its angular extension 76 are beyond lifer plates 82. The slot 84 is longer than slot 83 to permit adequate clearance in the slots of tube 56' when arm 55 is pivoted relative to the first lever, i.e., plates 56, plate 56'' and tube 56'. The distal end portion of latching arm 55 has a hole in which is fixedly mounted a cylindrical bar 85. Each L-shaped lifter plate 82 has a leg that abuts cylindrical bar 85 on arm 55 when the first lever is pivoted counterclockwise (as viewed in FIGS. 5 and 8) by extension of piston rod 71 of air cylinder 72 for the purpose of unlocking door assembly 18. This pivotal movement is a movement of the first lever from its second position at which it is spaced from door panel 17 of door assembly 18 to the first position, shown in phantom in FIGS. 5 and 8, at which the first lever is at its first position abutting panel 17.

The portion of arm 55 within square tube 56' has a hole in which is mounted a cylindrical bar 86. The end portions of cylindrical bar 86 are in holes of two spaced plates 87 that are connected to a square plate 88 that is inside tube 56' and that abuts spring 80. The plates 87 and plate 88 provide a spring seat assembly having a clevis construction. Thus spring 80 is retained in tube 56' between its closed end and the spring seat assembly. The spring 80 is substantially compressed, illustratively in excess of 870 pounds, when cylindrical bar 86 is in place extending through plates 87 and arm 55 and when arm 55 has been moved to a position relative to lifter plates 82 to permit the insertion of cylindrical bar 85 so that it will be engaged by lifter plates 82 for the lifting action on arm 55 when the first lever is pivotally moved from its second position.

The sequence of assembly of first lever and arm 55 with its connecting tube 53 is as follows: The integral assembly of plates 56, square tube 56' and plate 56'' is placed in an upside down position. The spring 80 is inserted in tube 56'. Of course, one end of spring 80 abuts the closed end of tube 56'. The spring seat assembly and locking arm 55 with its integral connecting tube 53 are joined by placing bar 86 into the holes of plates 87 and in arm 55 between these plates. This combination of arm 55, the spring seat assembly and bar 86 is positioned on the first lever so that arm 55 is between plates 56 with plates 56 pivotally straddling connecting tube 53 on opposite sides of arm 55 and so that the spring seat assembly is inside the open end portion of tube 56'. The arm 55 is pivotally moved relative to plates 56 of the first lever so as to compress spring 80 sufficiently to insert bar 85 within the included angle of lifter plates 82, i.e., the position described above. Then bar 85 is inserted in arm 55 and fixed in position by welding or the like. Instead of the straddle mounting of plates 56 on tube 53, small plates (not shown), each with an intermediate curved recess facing tube 53, can be welded to plates 56 to complete holes in the lever through which tube 53 passes for the mounting of the lever on tube 53 with pivotal movement of the lever relative to tube 53.

When door assembly 18 is closed and fully locked, as seen in full lines in FIGS. 5 and 8, piston rod 71 is at its retracted home position. In that case the first lever is at its second position in which plate 56'' is spaced from door panel 17. At that time, the angular disposition of the first lever and thus the location of lifter plates 82 is such that bar 85 is spaced from each of the outwardly extending legs of L-shaped plates 82. The angular extension 76 that serves as the latching lug of latching arm 55 engages locking lug 77 to maintain door assembly 18 in the locked condition. Because rod 85 on arm 55 is spaced from the outwardly extending legs of lifter plates 82 of the first lever when it is in its second position, compressed spring 80 provides a force on arm 55 to maintain it in this locked position.

The outer edge surface of the other leg of each lifter plate 82 is contoured so that it will not interfere with the relative movement of rod 85 and the lifting leg of each lifter plate 82 as occurs when arm 55 is pivoted, without movement of the first lever, if one or both of springs 67 are broken and door assembly 18 is being closed, as described later.

In view of the difference in the construction of the inverted V-shaped panel 36 with respect to the included angle and the difference in the mounting and configuration of door assembly 18 for the two especially preferred embodiments shown in FIGS. 5 and 8, the door assemblies for these embodiments are opened to a different extent and they can be referred to as a "short" stroke design and a "long" stroke design, respectively.

As seen in FIG. 1, the hopper car of the especially preferred embodiments of the invention has an air pressure tank 94 that is provided with pressurized air. The tank 94 is connected with suitable piping and valves (both not shown) to air cylinders 72. The operation of these valves determines the simultaneous operation of air cylinders 72. Such valves can be operated manually but it is preferred that they be tripped automatically by means alongside the track so that each air cylinder 72 will extend its piston rod 71 while such cars are in motion. After the cars have passed the unloading station the valve mechanism can be operated manually or automatically to close and lock the doors through retraction of piston rods 71.

For an opening of the two hopper door assemblies 18 the two door-operating mechanisms are operated simultaneously by energizing air cylinders 72. Each door-operating mechanism then has an outer movement of piston rod 71 that initially further compresses springs 67 until the pivot axes of pin 63, pin 60 and tube 53 are in alignment.

During this outer movement of piston rod 71 the first lever is pivoted about the axis of connecting tube 53 without pivotal movement of arm 55. As a result, lifter plates 82 are moved into abutment with rod 85 on arm 55. Depending upon the location of pin 85 and lifter plates 82 and other factors of a particular design, either lifter plates 82 can start the pivotal movement of arm 55 before the completion of pivotal movement of the first lever that places the pivot axes mentioned above in alignment, or this movement of arm 55 can be initiated after those axes are in alignment. In any event, pivotal movement of the first lever, by continued outer movement of distal rod 71, causes sufficient pivotal movement of latching arm 55 to clear locking lug 77. When latching arm 55 is being pivoted in this manner, torsion bars 46 are rotated to move latching arms 45 so that they clear locking lugs 44. As soon as angular extension 76, that is, the latching lug of arm 55, and latching lugs 45 are clear of their corresponding locking lugs, plate 56'' of the first lever of toggle assembly 57 bears against door panel 17 below opening 20. The further extension of piston rod 71 continues to allow or to allow and provide an opening of door assembly 18 until it is completely open, as shown in phantom in FIGS. 5 and 8. During part of this movement of door assembly 18, the door is opening due partly to the weight of the load of material in the car.

When it is desired to close and lock each door assembly 18 of either especially preferred embodiments, each air cylinder 72 is energized to retract its piston rod 71. In the case of the "long" stroke design of the construction of the car that is shown in FIG. 8, door assembly 18 when fully open has its center of gravity outwardly of the vertical longitudinal plane passing through hinge pins 30, whereas normally for the "short" stroke design shown in FIG. 5 the center of gravity of door assembly 18 is inwardly of that vertical plane passing through hinge pins 30. In the "long" stroke design the air cylinder 72 through its piston rod 71 connected to pin 60 controls the falling of door assembly 18 until its center of gravity is below hinge pins 30. From this position of door assembly 18 further retraction of piston rod 71, in the case of construction of FIG. 8, or from the fully open position of door assembly 18, in the case of construction of FIG. 5, the retraction of piston rod 71 from its inception produces a pulling force on pin 69 and thus through the first lever to bring door assembly 18 back up to its closed position. The springs 67 are sufficiently strong, so that while door assembly 18 is being closed, there is no pivotal movement of the first lever, i.e., plates 56 and 56'' and tube 56' about the pivot axis of arm 55. Accordingly, lifter plates 82 of the first lever are maintained in the same position relative to door assembly 18. Because of the continued abutment of these lifter plates against rod bar 85, spring 80 cannot pivot latching arm 55 about the axis of connecting tube 53. Thus clearance is maintained between the angular extension 76 of latching arm 55 and locking lug 77 until door assembly 18 is completely closed.

Upon further retraction of piston rod 71 the pulling force by retracting rod 71 turns the first lever about the pivot axis of tube 53. Until the axes of pin 63, pin 60 and tube 53 are in alignment, lever 61 is moved upwardly through block 62 and this causes further compression of springs 67. After these axes are brought into alignment further retraction of rod 71 moves lever 61 and the first lever of toggle assembly 57 about their pivot axes and the compression is partially reduced in springs 67. This pivotal movement of the first lever pivots its lifter plates 82 and tube 56' about the axis of tube 53 to pivot arm 55 about the axis of tube 53. This pivotal movement of arm 55 turns tube 53 and this rotates torsion bars 46 to pivot latching arms 45. The latching arm 55, at the completion of the retraction of piston rod 71, is brought into locking engagement with locking lug 77 and latching arms 45 are also brought into locking engagement with their associated locking lugs 44. The toggle assembly 57 is now at its locked overcenter condition. The position of the first lever, after door assembly 18 is closed and locked, is such that arm 55 fully engages lug 77 and the outwardly directed legs of lifter plates 82 are spaced from rod 85.

The prime function of spring 67 is to prevent movement of toggle assembly 57 from its unlocked overcenter condition in which plate 56'' of the first lever bears against panel 17 of door assembly 18 until door assembly 18 is closed. In the event that, during service use, at least one of springs 67 is broken as seen in FIG. 7, toggle assembly 57 will not remain in its unlocked overcenter condition when piston rod 71 is being retracted to close door assembly 18. As piston rod 71 is being retracted, the first lever is pivoted clockwise (as viewed in FIG. 7) until a lateral extension 95 of angular extension 59 of plate 56'' strikes stop means 15 that is mounted on door assembly 18 as described earlier. This limits the pivotal movement of the first lever, by the retraction of rod 71, to its second position at which the angular extension 76 of latching arm 55 is located to abut the inclined surface of locking lug 77 rather than striking the front edge of locking lug 77 that would prevent closing of the door. Thus during continued retraction of rod 71 to close the door, extension 76 of arm 55 slides along the inclined surface of lug 77. This is possible because arm 55 can move relative to the first lever by independently pivoting about the axis of tube 53. This pivotal movement of arm 55 results in bar 85 moving away from the outwardly extending legs of L-shaped plates 82 and results in a further compression of spring 80. When door assembly 18 is completely closed, extension 76 of arm 55 is located beyond lug 77. The spring 80 then forces a pivotal movement of arm 55 in the opposite direction to place extension 76 of arm 55 in locking engagement with lug 77.

It is seen from the foregoing that the first lever of toggle assembly 57 can function alone, i.e., without lever 61 and spring 67, to open and close door assembly 18. This is because the first lever, namely, the fixed assembly of plates 56, tube 56', plate 56'' and lifter plates 82 are combined with spring 80, the spring seat assembly, arm 55, and rods 85 and 86 in a manner to provide pivotal movement of arm 55 relative to plates 56 and to provide for pivotal movement of arm 55 in the other direction with the pivotal movement of plates 56. This combination constitutes a compound latching mechanism that is not required to have the first lever abutting door panel 17, while the door is being closed, to avoid striking the front edge of locking lug 77. The compound latching mechanism permits arm 55 to contact and then ride up the inclined top surface of latching lug 77 to permit complete closing of the door and wherein upon closing of the door the compound latching mechanism through spring 80 biases pivot arm 55 into locking position.

The locking lugs 44 are mounted so that arms 45 do not abut them before arm 55 starts to pivot while riding up the inclined surface of lug 77. As a result arms 45 clear lugs 42 due to the rotation of torsion bars 46 when arm 55 is being pivoted. As soon as arm 55 has its extension 76 beyond lug 77 the pivoting of arm 55 in the reverse direction for locking engagement with lug 77 results in the reverse rotation of torsion bars 46 to move arms 45 into locking engagement with lugs 44. This completes the three-point locking. This proper location of lugs 44 and the pivotal movement of arms 45, due to the pivotal movement of arm 55 rather than that of the first lever, avoids the necessity to use at the ends of the door the compound latching mechanism used at the center of the door.

The preferred embodiments of one construction of the hopper vehicle of the present invention have been presented above in the detailed description and have been shown in the drawings. In those embodiments the latching lug is an integral part of a latching arm that constitutes a latching means and it is mounted on the door assembly for pivotal movement to unlock the door and, if necessary, for pivotal movement to permit the latching lug to ride along the locking lug while the door is being closed. In that case, the latching means is a part of a compound latching mechanism that includes the lever that, in the illustrated embodiments, is one lever of a toggle assembly. Instead of this type of compound latching mechanism, this construction in an alternative embodiment can be one in which the latching mechanism includes a latching lug that is movable in a rectilinear manner rather than being pivoted by a lever connected to the power means when the lever is moved from its second position to its first position. In this modification, the latching means is mounted on the door assembly and is constructed in a manner such that its latching lug moves rectilinearly. In this case the latching means includes spring means to bias the latching lug so that when the door is closed the latching lug is biased at a position that provides a locking relationship with the locking lug. When this construction of the latching means is used, the vehicle will include means, preferably mounted on the door, to limit the movement due to the spring means so that the latching lug will not be moved to a position that will prevent the closing of the door assembly. In that embodiment, the latching lug cannot be moved by the spring means beyond the position at which it will suitably abut the locking lug, while the door is being closed, so that the latching lug can ride past the locking lug to permit closing of the door. Then the limit means is inoperative so that the spring means moves the latching lug to a position for locking engagement with the locking lug.

In the alternative embodiment of this construction of the hopper vehicle of the invention, it will be apparent that, when it is constructed to provide a three-point locking of the door assembly, the lever, that is pivotally mounted on the bottom portion of the door and that is operated by the power means, will be rigidly connected to a tube that will be connected to torsion bars 46. This is because the latching means will not be in the form of a latching arm pivotally mounted at the bottom portion of the door by being rigidly connected to such connecting tube, namely, tube 53.

In the construction of the hopper vehicle, described above as preferred embodiments and the alternative embodiment, the latching lug is movable, if required, during the closing of the door. In an alternative construction of the hopper vehicle of the present invention, the locking lug is a component of locking means that further includes means to bias the locking lug in its normal locking position but permits movement of the locking lug away from the latching lug, when necessary, to permit the latching lug to ride past the locking lug during the closing of the door. The details of such construction of such locking means will be apparent from the foregoing description. Of course, in this construction a lever, that is pivotally mounted on the bottom portion of the door, that is operatively connected at its distal end portion to the power means, and that has an angular extension functioning as a latching lug, such as disclosed in said copending patent application, can be used in this alternative construction of the hopper vehicle of the present invention.

The foregoing detailed description of preferred embodiments and a description of an alternative embodiment of one construction and a description of an alternative construction of a freight hopper car have been presented only for the purpose of illustration of the hopper vehicle of the invention. The present invention is limited only by the claims that follow.

We claim:

1. A hopper vehicle having a pair of bottom hoppers extending lengthwise of the vehicle on opposite sides of the vertical central plane of the vehicle, which comprises:

a supporting structure including support means extending from about one end of the vehicle to about the other end of the vehicle and located at the bottom portion of the vehicle for mounting on wheeled assemblies of the vehicle;

a body structure including: end walls; side walls;

an inverted generally V-shaped panel mounted on said support means and extending lengthwise of the vehicle and providing a part of said hoppers; and a door assembly hingedly mounted at its upper margin on each of said side walls to swing outwardly and constructed to provide one side of one of said two hoppers of the vehicle;

a door-operating mechanism for each of said door assemblies and located intermediate the length of the door assembly, each of said door-operating mechanisms including:

a lever pivotally mounted at its bottom end on the bottom margin of said door assembly and movable between a first position abutting the inside of said door assembly when the door is unlocked and a second position spaced from the inside of said door assembly when the door is closed and locked;

latching means mounted on said door assembly and including a latching lug, said latching means and said lever being constructed and arranged to provide movement of said latching lug of said latching means when said lever is pivotally moved from said second position to said first position; and power means mounted on said support means and operatively connected to said lever to provide a force in one direction for movement of said lever from said second position to said first position and to provide a force in the opposite direction on said lever for return movement of said door assembly to its closed position and movement of said lever from said first position to said second position;

locking means, including a locking lug, mounted on said supporting structure in alignment with each of said latching lugs of said latching means to have said locking lugs engaged in a locking manner by said latching lugs after said door assemblies are closed and said levers have been moved to their second positions; and one of said latching means and of said locking means, for each side of said hopper vehicle, has a construction, including spring means that engages said lug of that one means having said spring means, so that this engaged lug is movable in the event that said latching means abuts said locking means during a closing of said door assembly and is returned by said spring means to its normal position when the door assembly is closed.

2. A hopper vehicle having a pair of bottom hoppers extending lengthwise of the vehicle on opposite sides of the vertical central plane of the vehicle, which comprises:

a supporting structure including support means extending from about one end of the vehicle to about the other end of the vehicle and located at the bottom portion of the vehicle for mounting on wheeled assemblies of the vehicle;

a body structure including:

end walls;

side walls;

an inverted generally V-shaped panel mounted on said support means and extending lengthwise of the vehicle and providing a part of said hoppers; and a door assembly hingedly mounted at its upper margin on each of said side walls to swing outwardly and constructed to provide one side of one of said two hoppers of the vehicle;

a door-operating mechanism for each of said door assemblies and located intermediate the length of the door assembly, each of said door-operating mechanisms including:

latching means mounted on said door assembly and including a downwardly directed portion that is constructed to function as a latching lug;

a lever pivotally mounted at its bottom end on the bottom margin of said door assembly and movable between a first position abutting the inside of said door assembly when the door is unlocked and a second position spaced from the inside of said door assembly when the door is closed and locked, said lever and said latching means being constructed and arranged so that said lever moves said latching lug of said latching means upwardly when said lever is pivotally moved from said second position to said first position;

means mounted on said lever to bias said latching lug of said latching means in the direction opposite to that provided by the pivotal movement of said lever from said second position to said first position;

means mounted on said door assembly to limit said movement of said latching lug provided by said lugbiasing means; and power means mounted on said support means and operatively connected to said lever to provide a force in one direction for movement of said lever from said second position to said first position and to provide a force in the opposite direction on said lever for return movement of said door assembly to its closed position and movement of said lever from said first position to said second position; and locking means mounted on said supporting structure in alignment with each of said latching means to be engaged in a locking manner by said latching lugs provided by said downwardly directed portion of said latching means after said door assemblies are closed and said levers have been moved to their second positions.

3. A hopper vehicle having a pair of bottom hoppers extending lengthwise of the vehicle on opposite sides of the vertical central plane of the vehicle, which comprises:

a supporting structure including support means extending from about one end of the vehicle to about the other end of the vehicle and located at the bottom portion of the vehicle for mounting on wheeled assemblies of the vehicle;

a body structure including:

end walls;

side walls;

an inverted generally V-shaped panel mounted on said support means and extending lengthwise of the vehicle and providing a part of said hoppers; and a door assembly hingedly mounted at its upper margin on each of said side walls to swing outwardly and constructed to provide one side of one of said two hoppers of the vehicle;

a door-operating mechanism for each of said door assemblies and located intermediate the length of the door assembly, each of said door-operating mechanisms including:

a latching arm pivotally mounted at its bottom end on the bottom margin of said door assembly and its distal end portion having an inwardly directed extension that is constructed to function as a latching lug;

a lever pivotally mounted at its bottom end on the bottom margin of said door assembly and movable between a first position abutting the inside of said door assembly when the door is unlocked and a second position spaced from the inside of said door assembly when the door is closed and locked, said lever being constructed to engage and pivotally move said latching arm with said lever when it is pivotally moved from said second position to said first position;

means mounted on said lever to bias said latching arm for pivotal movement in the direction opposite to that provided by the pivotal movement of said lever from said second position to said first position, said pivotal movement of said latching arm by said arm-biasing means being limited by said construction of said lever that provides a movement of said latching arm with said lever when said lever is moved from said second position to said first position; and power means mounted on said support means and operatively connected to said lever to provide a force in one direction for movement of said lever from said second position to said first position and to provide a force in the opposite direction on said lever for return movement of said door assembly to its closed position and movement of said lever from said first position to said second position; and locking means mounted on said supporting structure in alignment with each of said latching arms to be engaged in a locking manner by said latching lugs provided by said extensions of said latching arms after said door assemblies are closed and said levers have been moved to their second positions.

4. The hopper vehicle of claim 3 wherein:

said latching arm and said lever have a common pivot axis; and said arm-biasing means comprises spring means mounted on said lever and operatively connected at one end to said latching arm adjacent to its distal end.

5. The hopper vehicle of claim 4 wherein each of said power means includes a power cylinder pivotally mounted on one end of said support means about an axis parallel to the longitudinal axis of the vehicle and a piston rod directed to that door assembly operated by said power means and operatively connected to said lever.

6. The hopper vehicle of claim 4 wherein:

the bottom portion of said lever is bifurcated in the form of two spaced plates;

said lever includes as an integral part of its construction a tube operatively closed at its upper end and having an open bottom end facing downwardly and inwardly, said tube having at its bottom portion a pair of slots at a plane parallel to and between said spaced plates of the bifurcated portion of said lever;

said latching arm is pivotally mounted on said door assembly between said pair of spaced plates of said lever and extends through said pair of longitudinal slots in said tube of said lever so that the distal end of said latching arm is on the side of said tube opposite said pivotal axis of said latching arm;

said spring means includes a spring mounted in said tube and a spring seat assembly mounted in said tube and abutting one end of said spring adjacent to open end of said tube, said spring seat assembly having a bottom portion comprising a pair of spaced plates between which said latching arm passes and to which said latching arm is connected to provide a bias on said arm in a direction downwardly and inwardly toward the vertical longitudinal plane of the vehicle; and said lever includes lifter means mounted on said tube to engage and pivotally move said latching arm away from said locking lug when said lever is moved from said second position to said first position and to limit the pivotal movement of said arm in the opposite direction.

7. The hopper vehicle of claim 6 wherein each of said power means includes a power cylinder pivotally mounted on one end of said support means about an axis parallel to the longitudinal axis of the vehicle and a piston rod directed to that door assembly operated by said power means and operatively connected to said lever, said vehicle further including stop means mounted on said door assembly to prevent movement of said lever beyond said second position when it is moved from said first position to said second position by said power means.

8. The hopper vehicle of claim 7 wherein:

each door assembly has an opening in alignment with a top portion of said lever of said door-operating mechanism for that door assembly;

each of said levers has at its top portion an angular extension that is outwardly directed through said opening in said door assembly when open and closed; and said stop means is mounted on said door assembly for engagement by said angular extension of said lever to prevent movement of said lever by said power means beyond said second position when moved from said first position.

9. The hopper vehicle of claim 5 and further including for each door-operating mechanism, means operatively connected to said lever to provide against said lever, when in its first position, a sufficient force to prevent movement of said lever from said first position when said power means provides a force in said opposite direction greater than the force of gravity acting on door assembly for movement of said door assembly to its closed position.

10. The hopper vehicle of claim 9 wherein said means operatively connected to said lever to provide a sufficient force against said lever to maintain it in said first position during movement of said door assembly to its closed position comprises spring means mounted on said door assembly and connected to said lever.

11. The hopper vehicle of claim 9 wherein each of said means operatively connected to said lever to provide a sufficient force against said lever to maintain it in said first position during movement of said door assembly to its closed position comprises:

a second lever pivotally connected at one end to the top of said first lever to constitute, with said first lever, a toggle assembly;

means pivotally mounting the other end of said second lever of each toggle assembly on the top portion of said door assembly and constructed to permit movement of said second lever along its longitudinal axis; and second spring bias means to provide said sufficient force on said first lever through said second lever to maintain said first lever in said first position during movement of said door assembly to its closed position by said power cylinder through said first lever, said toggle assembly being in one overcenter condition when said first lever is at its first position and being at a second overcenter condition when said first lever is at its said second position, said overcenter conditions being on the opposite sides of the plane passing through the three pivotal axes of said toggle assembly when they are in alignment.

12. The hopper vehicle of claim 11 wherein:

said second lever has a longitudinal slot at its top portion;

said means pivotally mounting said other end of said second lever while permitting movement of said second lever along its axis comprises:

a pair of spaced plates that extend inwardly from said door assembly and that have aligned holes;

a spring retainer block having a central opening mounted on the upper portion of said second lever and having a transverse hole; and a pin passing through said holes of said pair of spaced plates of said pivotal mounting means, said transverse hole in said block and through said longitudinal slot in said second lever;

said second lever has a clevis construction at its said one end for pivotally connecting said second lever to said first lever and said second lever is constructed generally for the rest of its length in the form of a cylindrical rod extending through said central opening of said spring retainer block; and said second spring bias means on said second lever is mounted on said cylindrical rod portion of said second lever between and abutting said spring retainer block and said clevis construction of said second lever.

13. The hopper vehicle of claim 12 wherein each of said power means includes a power cylinder pivotally mounted on one end of said support means about an axis parallel to the longitudinal axis of the vehicle and a piston rod directed to that door assembly operated by said power means and operatively connected to said lever.

14. The hopper vehicle of claim 13 wherein:

the bottom portion of said lever is bifurcated in the form of two spaced plates;

said lever includes as an integral part of its construction a tube operatively closed at its upper end and having an open bottom end facing downwardly and inwardly, said tube having at its bottom portion a pair of slots at a plane parallel to and between said spaced plates of the bifurcated portion of said lever;

said latching arm is pivotally mounted on said door assembly between said pair of spaced plates of said lever and extends through said pair of longitudinal slots in said tube of said lever so that the distal end of said latching arm is on the side of said tube opposite said pivotal axis of said latching arm;

said spring means includes a spring mounted in said tube and a spring seat assembly mounted in said tube and abutting one end of said spring adjacent to the open end of said tube, said spring seat assembly having a bottom portion comprising a pair of spaced plates between which said latching arm passes and to which said latching arm is connected to provide a bias on said arm in a direction downwardly and inwardly toward the vertical longitudinal plane of the vehicle; and said lever includes lifter means mounted on said tube to engage and pivotally move said latching arm away from said locking lug when said lever is moved from said second position to said first position and to limit the pivotal movement of said arm in the opposite direction.

15. The hopper vehicle of claim 14 and further including:

a connecting stub tube mounted on the bottom margin of each door assembly for rotatable movement about a horizontal axis, said latching arm being fixedly mounted on said stub tube for pivotal mounting of said arm on the bottom margin of said door assembly, and said first lever of said toggle assembly being mounted on said stub tube for pivotal movement of said first lever on the bottom margin of said door assembly relative to said stub tube;

a pair of locking means mounted on said supporting structure adjacent the ends of the bottom margin of each door assembly;

a pair of torsion bars fixedly mounted on the ends of each of said connecting stub tubes for rotation with it and extending toward the ends of said door assembly, said other end of each said torsion bar having fixedly mounted on it an arm constructed at its free end to constitute a latching lug, said arms being located at the transverse plane of said pair of locking means, adjacent the ends of the bottom margin of said door assembly, to provide a locking of said door assembly adjacent the ends with the locking of the door assembly by locking of said latching lug extension of said latching arm on said stub tube with said locking means mounted on said supporting structure in alignment with that latching arm.

16. The hopper vehicle of claim 3 wherein:

the bottom portion of said lever is bifurcated in the form of two spaced plates;

said lever includes as an integral part of its construction a tube operatively closed at its upper end and having an open bottom end facing downwardly and inwardly, said tube having at its bottom portion a pair of slots at a plane parallel to and between said spaced plates of the bifurcated portion of said lever;

said latching arm is pivotally mounted on said door assembly between said pair of spaced plates of said lever and extends through said pair of longitudinal slots in said tube of said lever so that the distal end of said latching arm is on the side of said tube opposite said pivotal axis of said latching arm;

said spring means includes a spring mounted in said tube and a spring seat assembly mounted in said tube and abutting one end of said spring adjacent to the open end of said tube, said spring seat assembly having a bottom portion comprising a pair of spaced plates between which said latching arm passes and to which said latching arm is connected to provide a bias on said arm in a direction downwardly and inwardly toward the vertical longitudinal plane of the vehicle; and said lever includes lifter means mounted on said tube to engage and pivotally move said latching arm away from said second position to said first position and to limit the pivotal movement of said arm in the opposite direction, and further including:

a connecting stub tube mounted on the bottom margin of each door assembly for rotatable movement about a horizontal axis, said latching arm being fixedly mounted on said stub tube for pivotal mounting of said arm on the bottom margin of said door assembly, and said first lever of said toggle assembly being mounted on said stub tube for pivotal movement of said first lever on the bottom margin of said door assembly relative to said stub tube;

a pair of locking means mounted on said supporting structure adjacent the ends of the bottom margin of each door assembly;

a pair of torsion bars fixedly mounted on the ends of each of said connecting stub tubes for rotation with it and extending toward the ends of said door assembly, said other end of each said torsion bar having fixedly mounted on it an arm constructed at its free end to constitute a latching lug, said arms being located at the transverse plane of said pair of locking means, adjacent the ends of the bottom margin of said door assembly, to provide a locking of said door assembly adjacent the ends with the locking of the door assembly by locking of said latching lug extension of said latching arm on said stub tube with said locking means mounted on said supporting structure in alignment with that latching arm.

17. The hopper vehicle of claim 16 wherein each of said power means includes a power cylinder pivotally mounted on one end of said support means about an axis parallel to the longitudinal axis of the vehicle and a piston rod directed to that door assembly operated by said power means and operatively connected to said lever, said vehicle further including stop means mounted on said door assembly to prevent movement of said lever beyond said second position when it is moved from said first position to said second position by said power means.

18. The hopper vehicle of claim 17 wherein:

each door assembly has an opening in alignment with a top portion of said lever of said door-operating mechanism for that door assembly;

each of said levers has at its top portion an angular extension that is outwardly directed through said opening in said door assembly when open and closed; and said stop means is mounted on said door assembly for engagement by said angular extension of said lever to prevent movement of said lever by said power means beyond said second position when moved from said first position.

* * * * *